United States Patent [19]

Campi et al.

[11] Patent Number: 4,521,781

[45] Date of Patent: Jun. 4, 1985

[54] PHASE SCANNED MICROSTRIP ARRAY ANTENNA

[75] Inventors: Morris Campi; Arthur R. Sindoris, both of Silver Spring, Md.

[73] Assignee: The United States of America as represented by the Secretary of the Army, Washington, D.C.

[21] Appl. No.: 484,326

[22] Filed: Apr. 12, 1983

[51] Int. Cl.[3] ..... H01Q 1/38; H01Q 3/26

[52] U.S. Cl. ..... 343/700 MS; 333/246; 343/372

[58] Field of Search ..... 343/700 MS, 829, 830, 343/846, 876, 371, 372; 333/246

[56] References Cited

U.S. PATENT DOCUMENTS 4,379,296 4/1983 Farrar et al. ..... 343/700 MS

*Primary Examiner*—Eli Lieberman

*Attorney, Agent, or Firm*—Anthony T. Lane; Robert P. Gibson; Saul Elbaum

[57] ABSTRACT

A microstrip array antenna, including spaced radiator elements supplied with microwave power and separated from an underlying ground reference plane by a layer of dielectric material, in which the antenna beam is phase scanned by periodically closing switching devices connected between the reference plane and at least one null point of each radiator element. In one embodiment, the radiator elements are identical rectangular patches disposed along a path, each patch having a length parallel to the path of one-half wavelength and a width transverse to the path not exceeding one wavelength in the underlying dielectric material at the antenna operating frequency. The patches are connected in series to receive microwave power by conductive strip elements whose widths are selected to effect a desired distribution of radiated microwave power from the patches.

11 Claims, 3 Drawing Figures

PHASE SCANNED MICROSTRIP ARRAY ANTENNA

RIGHTS OF THE GOVERNMENT

The invention described herein may be manufactured and used by or for the United States Government for governmental purposes without payments of any royalty thereon.

BACKGROUND OF THE INVENTION

The invention relates generally to radio frequency antennas, and, more particularly, to a phase scanned microstrip series array antenna.

The concept of using microstrip patches of various widths to form a series antenna array is well known to the art. Typically, the series antenna arrays are formed by photo-etching processes from a laminated starting material consisting of a dielectric substrate layer laminated between two conductive sheets. Typically, one of the conductive sheets is used as the ground or reference plane of the microstrip antenna, while the other opposite conductive sheet is photo-etched to form a plurality of microstrip patches connected in series by transmission line segments, as for example described in U.S. Pat. No. 4,180,817, issued Dec. 25, 1979 to Sanford.

When rectangular microstrip patches are utilized in the series antenna arrays, the conductance G of each patch is a function of the printed strip width. The ratio $G/G_o$ of this conductance G with $G_o$, the line conductance of the transmission line segment supplying r.f. energy to the patch, determines the quantity of power radiated from the edges of the patch. To establish a desired distribution of radiated power, each patch element in the array must be configured to have a specific conductance as a function of its position in the array.

In general, beam scanning of a microstrip series antenna array is accomplished by introducing signal phase shifts between the patch elements of the array so that the main beam can be aimed at a given direction. In the past, this has been done by either changing the operating frequency, which changes the electrical path length between the patch elements, or by inserting phase shifting devices in the signal path between the patch elements.

Until the present invention, it has been difficult to design a beam scanned microstrip series antenna array having a narrow main beam and low side lobes, because of the following design considerations:

(1) To avoid excessive phasing and moding, the width of each patch element must be narrower than a wavelength in the dielectric material, preferably narrower than one half wavelength. However, in order for the series antenna array to be 100 percent efficient, the last patch element in the series of patch elements must have an impedance equal to the impedance of the transmission line connecting these elements, typically 50 to 100 ohms. To achieve this impedance, the last patch element generally must have a width which is much greater than one half the wavelength in the dielectric material, which, in turn, results in excessive phasing and moding.

(2) Since each patch element has a different insertion phase, a uniform patch separation cannot be used. Also, the resonant length of each patch element is different because of the presence of the patch phase. Thus, beam scanning by varying the frequency would be minimal before all semblance of the array properties are destroyed by the presence of the various patch phases. On the other hand, since each patch has a different insertion phase, scanning by means of applying external phasing to each patch element requires different circuitry for each patch element.

OBJECTS AND SUMMARY OF THE INVENTION

It is an object of the invention to provide a series microstrip antenna array which can be shifted or scanned easily while operating at a constant single frequency.

It is another object of the invention to provide a phase scanned series microstrip antenna array having substantially identical microwave radiator patch elements.

The invention described herein does not use devices in the feed or signal path between the patch elements nor does it require the changing of the antenna operating frequency; rather, the invention utilizes the insertion phase characteristics inherent in every microstrip patch element, to provide a simple way of shifting the element phase relationship without interfering with the operating signal or frequency.

In a preferred embodiment of the invention, a microstrip array antenna includes a plurality of series connected, rectangular radiating patch elements, each having a resonant length of approximately one half the wavelength at a desired operating frequency in the dielectric material underlying these patch elements. In this preferred embodiment, the patch phase disparity discussed above is avoided by using the same patch width for each patch element. Since the power radiated from each patch element depends on the ratio of the conductance G of the patch element to the conductance $G_o$ of the supply transmission line to the patch element, the distribution of radiative power from each patch element is controlled by employing different width transmission lines between the patch elements, while maintaining the same width for all patch elements. As discussed above, the patch element width must be less than a wavelength at the operating frequency in the underlying dielectric material to eliminate excessive phasing and moding. Also, if the patch width is selected to provide about 90° insertion phase, small perturbations of each patch element will cause large excursions of the insertion phase. Beam scanning may be accomplished by creating and controlling such perturbations of the patch elements.

Switchable elements, such as shorting stubs, PIN diodes, or other devices, may be connected between each patch element and the underlying reference element along the patch element outer edges at the null point in the resonant dimension. If mixed moding occurs during operation of this antenna array, these shorting devices will reduce the extraneous modes. Also, the insertion of these devices reduces the insertion phase without appreciably affecting the quantity of radiated power. This controlled varying of insertion phase (modulation) changes the electrical path links between the patch elements to thus cause beam scanning.

This technique of phase modulation also works on arrays which are corporately fed. In such a case, the patch element separation is fixed due to the independent signal feeding process. However, varying the phase of each patch element introduces a phase shift in the signal radiating from these elements. Thus, beam scanning can be again be accomplished with proper choice of element insertion phase devies.

BRIEF DESCRIPTION OF THE DRAWINGS

Further features and objects of this invention will become more apparent by reference to the following description, taken in conjuction with the accompanying drawings in which.

DESCRIPTION OF PREFERRED EMBODIMENTS

Figure 1:
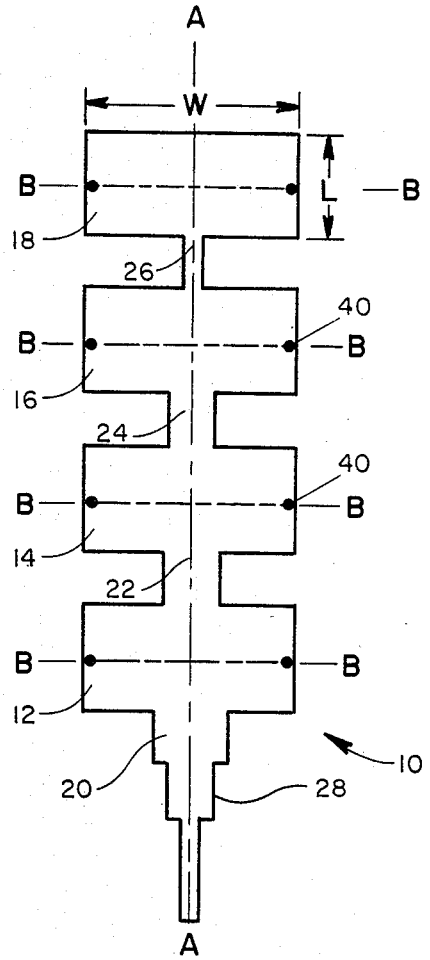
FIG. 1 is a plan view of a phase scanned series microstrip antenna array, according to the invention.

The microstrip antenna array 10 shown in FIG. 1 includes a plurality of patch elements 12, 14, 16, and 18, which are connected in series by transmission line segments 20, 22, 24, and 26. Microwave energy is supplied to the first transmission line segment 20 through a stepped line portion 28 which serves as an impedance matching transformer for the antenna array.

Each of the rectangular patch elements 12, 14, 16, and 18 have identically dimensioned longitudinal and transverse sides. The longitudinal sides extend parallel to the array axis A—A for a resonant length L of approximately one half wavelength at the selcted microwave operating frequency in the dielectric material 30 underlying the patch elements. The transverse sides of the patch extend orthogonally of the array axis A—A for a distance W which does not exceed approximately one wavelength at the antenna operating frequency in the underlying layer of dielectric material 30. The transverse edges of each patch element 12–18 define, with a ground plane 32 of conductive material underlying the layer of dielectric material 30, a radiating slot aperture from which microwave power is radiated outward. The two transverse radiating edges of each patch element 12–18 define a null axis B—B of the patch element which extends orthogonally of the array axis A—A equidistant from the two radiating transverse edges.

The microwave power radiated from each patch element 12–18 is a function of the ratio of the patch conductance G to the line conductance $G_o$ of the transmission line segment supplying the patch element. Since each patch conductance G is a function of the patch element width W and each line conductance $G_o$ is a function of the width of the transmission line segment associated with the particular patch element, and since all of the patch elements have the same width W, the distribution of radiated power among the patch elements is determined by the width of the transmission line segments supplying power to these patch elements. Thus, as the width of the transmission line segment is decreased, the power radiated by the patch element fed by this transmission line segment increases. For example, in the embodiment shown in FIG. 1, the transmission line segment 26 feeding the end patch element 18 has a relatively narrow width to increase the power radiated from this end patch element 18. Similarly, the transmission line segment 20 feeding the first patch element has a relatively wide width to thus limit the power radiated from this first element 12.

Figure 2:
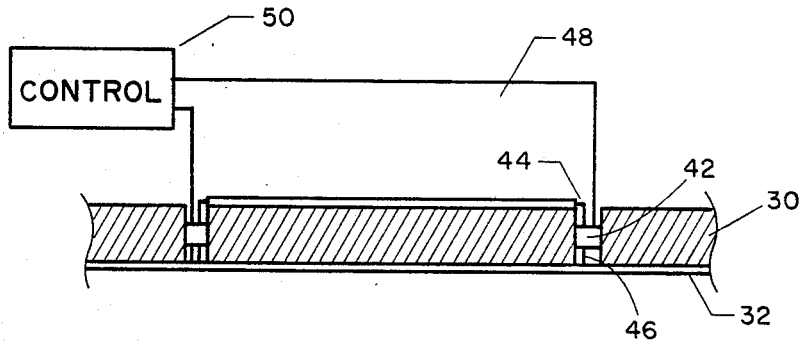
FIG. 2 is a cross sectional view of the embodiment of FIG. 1, taken along the null axis B—B of one of the patch elements of the array.

Two shorting elements 40 are disposed along the null axis B—B on opposites longitudinal sides of each patch element 12–18, to connect the patch element with the underlying ground plane element 32. These shorting elements 40 may be adjustable shorting posts, or semiconductor switching devices, such as the PIN diodes 42 shown in FIG. 2. Each of these of these PIN diodes are disposed in an opening extending between the patch element 12, 14, 16, or 18 and the ground plane element 32. Each diode 42 has one line terminal or lead 44 connected to the patch member, an opposite line terminal or lead 46 connected to the ground plane element 32, and a control terminal or lead 48 connected to a control circit, such as a microcomputer 50, which periodically switches the PIN diodes 42 on and off to thus change the patch element insertion phase and the electrical path lengths between the patch elements, causing beam scanning.

Figure 3:
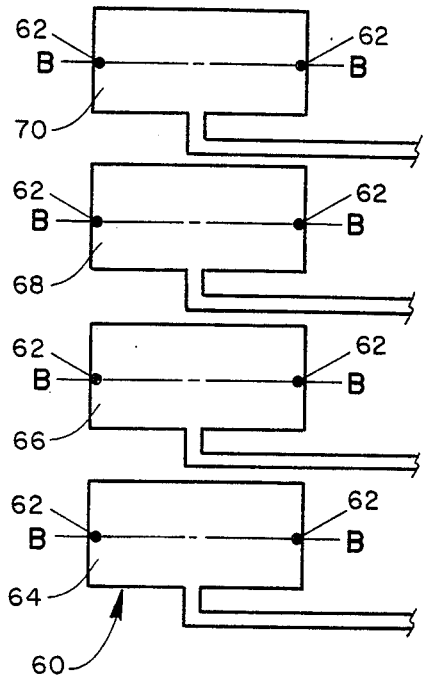
FIG. 3 is a plan view of a corporately fed, phase scanned microstrip array antenna, according to the invention.

This method of phase scanning a series microstrip antenna array by switching at least one shorting element associated with each patch element of the array can also be used on microstrip antenna arrays which are corporately fed, as for example the array shown in FIG. 3. In such corporately fed arrays, the patch element separation is fixed because of the independent signal feeding process. However, varying the phase of each patch element by switching the shorting elements associated with each patch element introduces a phase shift in the signal radiating from each patch element. Thus, beam scanning can again be accomplished with proper choice of switchable shorting devices.

For example, in the corporately fed microstrip antenna array 60 shown in FIG. 3, two shorting switches 62 are disposed along the null axis B—B on opposite sides of each patch element 64, 66, 68 or 70. These shorting switches 62 may be periodically closed to respectively connect the patch elements 64–70 to the underlying ground plane element, to thus introduce a phase shift in the signals radiating from these patch elements, causing beam scanning.

In view of the many obvious modifications, variations, and additions which can be made to the invention described herein by those skilled in the art, it is intended that the scope of this invention be limited only by the appended claims.

What is claimed and desired to be secured by Letters Patent of the United States is:

1. A microstrip array antenna, comprising:

an electrically conductive reference surface;

a layer of dielectric material overlying said reference surface;

a plurality of electrically conductive, spaced apart, radiator elements overlying said layer of dielectric material, each radiator element including at least one radiating edge, and each radiator element having an effective dimension transverse to said radiating edge of approximately one-half wavelength, or a multiple of one-half wavelength, in the underlying dielectric material at a predetermined antenna operating frequency;

microwave supply means for supplying microwave energy to each radiator element at said antenna operating frequency; and scanning means for phase scanning the antenna beam, comprising:

a plurality of switching means associated respectively with said radiator elements, each switching means being connected between a null point of the associated radiator element and the reference surface, and switch control means for periodically closing and opening said plurality of switching means.

2. An antenna, as described in claim 1, wherein:

said radiator elements are disposed along a longitudinal path; and each radiator element comprises two parallel radiating edges which are spaced apart by substantially one-half wavelength in the underlying dielectric material at the antenna operating frequency and which extend transversely of the longitudinal path.

3. An antenna, as described in claim 2, wherein each radiator element is a rectangular element having a transverse width which does not exceed one wavelength at the antenna operating frequency in the underlying dielectric material.

4. An antenna, as described in claim 3, wherein said radiator elements have identical transverse and longitudinal dimensions.

5. An antenna, as descirbed in claim 4, wherein said microwave supply means comprises:

a plurality of electrically conductive transmission line elements overlying said layer of dielectric material, for interconnecting said radiator elements in series along said path, each transmission line element being connected to supply microwave energy from one radiator element to a subsequent radiator element; and an electrically conductive input means overlying said layer of dielectric material, for supplying microwave energy to a first one of said radiator elements;

wherein the widths of said transmission line elements are selected to effect a desired distribution of radiated microwave power from the plurality of radiator elements.

6. An antenna, as described in claim 2, wherein said plurality of switching means comprises a plurality of pairs of switching devices associated respectively with said radiator elements, the switching devices of each pair being connected between said reference surface and respective null points on opposite longitudinal sides of the associated radiator element.

7. An antenna, as described in claim 6, wherein said switching devices are PIN diodes.

8. A microstrip array antenna, comprising:

an electrically conductive reference surface;

a layer of dielectric material overlying said reference surface;

a plurality of electrically conductive rectangular radiator elements overlying said layer of dielectric material and spaced apart along a longitudinal path, said radiator elements having identical widths transverse to said path and having identical lengths parallel to said path; and microwave supply means for supplying microwave energy to each radiator element at a predetermined antenna operating frequency, including:

an electrically conductive input element overlying said layer of dielectric material, for supplying microwave energy to a first one of said radiator elements, a plurality of electrically conductive transmission line elements overlying said layer of dielectric material, for interconnecting said radiator elements in series along said path, each transmission line element being connected to supply microwave energy from one radiator element to a subsequent radiator element, the widths of said transmission line elements being selected to effect a desired distribution of radiated microwave power from the plurality of radiator elements.

9. An antenna, described in claim 8, wherein each radiator element has a length parallel to said path of approximately one-half wavelength at the antenna operating frequency in the underlying dielectric material and has a width transverse to said path not exceeding one wavelength at the antenna operating frequency in the underlying dielectric material.

10. An antenna, as described in claim 9, which further includes scanning means for phase scanning the antenna beam, comprising:

a plurality of switching means associated respectively with said radiator elements, each switching means being connected between a null point of the associated radiator element and the reference surface; and switch control means for periodically closing and opening said plurality of switching means.

11. A microstrip array antenna, comprising:

an electrically conductive reference surface;

a layer of dielectric material overlying the reference surface;

a plurality of electrically conductive, radiator elements overlying the layer of dielectric material and space apart along a longitudinal path, each radiator element comprising two transversely extending parallel radiating edges which are spaced apart by substantially one-half wavelength in the underlying dielectric material at a predetermined antenna operating frequency and which define a null axis which extends transversely equidistant from the two radiating edges;

microwave supply means for supplying microwave energy to each radiator element at the predetermined antenna operating frequency; and scanning means for phase scanning the antenna beam, comprising:

a plurality of pairs of switching means associated respectively with the radiator elements, the switching means of each pair being connected between the reference surface and respective null points along the null axis on opposite longitudinal sides of the associated radiator element; and switch control means for periodically closing and opening the switching means.

* * * * *